United States Patent [19]

Lockwood

[11] 4,036,420

[45] July 19, 1977

[54] PINWHEEL FOR PAPER FEEDING

[76] Inventor: Frank J. Lockwood, 7011 W. Archer Ave., Chicago, Ill. 60638

[21] Appl. No.: 741,735

[22] Filed: Nov. 15, 1976

Related U.S. Application Data

[63] Continuation-in-part of Ser. No. 640,259, Dec. 13, 1975, abandoned.

[51] Int. Cl.[2] ..... B65H 17/38
[52] U.S. Cl. ..... 226/87; 226/81
[58] Field of Search ..... 226/74–87

[56] References Cited

U.S. PATENT DOCUMENTS

| | | | |
|---|---|---|---|
| 2,095,293 | 10/1937 | Sherman | 226/79 X |
| 2,102,651 | 12/1937 | Sherman et al. | 226/81 X |
| 2,452,591 | 11/1948 | Metzner | 226/87 |
| 2,822,167 | 2/1958 | Metzner | 226/81 |
| 2,892,628 | 6/1959 | Zeigle | 226/87 |

*Primary Examiner*—Robert W. Saifer
*Attorney, Agent, or Firm*—Robert E. Wagner; Gerald T. Shekleton

[57] ABSTRACT

A continuous form pinwheel, having pins of a durable plastic material, the pins being closely fitted in their seats for the exclusion of foreign matter, having a unique cam follower and radiused at their lower end, all of which factors lead to decreased friction and an increased life of the pins.

10 Claims, 5 Drawing Figures

PINWHEEL FOR PAPER FEEDING

This is a continuation-in-part of application Ser. No. 640,259, filed Dec. 13, 1975 now abandoned.

BACKGROUND OF THE INVENTION

This device relates to an apparatus for feeding paper; more particularly, it relates to a continuous form pinwheel adaptable to feed paper to collators, folders and interlevers, and other machines where registration can be maintained by pinwheels.

In the manufacture of paper feeding machines and the like, one of the most important parts to be constructed is the pinwheel. It is the pinwheel which drives or progresses the paper through such a machine. Because of its important function, it is imperative that the pinwheel be very accurately formed; otherwise, the paper forms being fed may become damaged or misaligned or the machine may become fouled.

Due to the nature of the particular application of feeding paper forms, no or little lubricant of any type may be used, as the particular lubricant used would be deposited on the paper surface being fed, creating an unsightly and unacceptable smear on the paper. Thus, current pinwheels present the problem of a short life and expensive manufacture.

In prior paper feeding machines, the operable pinwheels were prepared through a very laborious, tedious and expensive operation. They are generally made of a cast iron block into which small holes are bored as cylinders. Into these small holes metal pins are secured. These pins are machined to the desired size, shaped insofar as was possible to form the desired teeth required to fit into the openings of the perforated forms to feed the progression of the forms through the machine. This method of forming the pinwheel is very unsatisfactory, it being very difficult to manufacture the pinwheels according to specifications, and very costly because of the time and labor required.

SUMMARY OF THE INVENTION

The present invention obviates these disadvantages while introducing some innovations in its improvements over the prior art. The pinwheel of the present invention in one embodiment may be cast of aluminum. Aluminum is well known to be lightweight and easily machineable. However, it also oxidizes easily, and the aluminum oxide thus formed would normally deposit on the paper being fed through the machine. This would result in increased wear and a short usable life of the pinwheel. However, by this embodiment of the present invention, the use of aluminum allows the machinist to easily mount and machine the platen. The lightweight characteristics allow the machining apparatus to be of a corresponding lighter weight structurally, thereby becoming less expensive to buy and maintain. While the softness of the aluminum permits the platen to be quickly and easily machined without the usual wear or on the grinding wheel, the low density of the aluminum permits facility in handling and positioning of the platen both prior to and after the grinding process. Thus, not only is it easier and quicker to machine the platen in this embodiment of the invention, but the apparatus required to accomplish this, the most time-consuming manufacturing step, is considerably simplified and less expensive. Following this step, the aluminum is then anodized in a manner well known to those in the art. In this way, all the advantages of aluminum recited above are retained while gaining the wearing characteristics of cast iron. However, the conventional cast iron may also be utilized, in a conventional manner when using the unique pins of the subject invention, as will be described.

The sockets in which the pins travel may be machined to close tolerances at a minimal expense due to the above-described use of aluminum. Thus, the entry of paper dust into the pinwheel can be easily prevented by these close tolerances so that the cam mechanism and driving gears within the pinwheels are not fouled, and the tolerances between the socket and the pins are not increased by an excessive wear caused by such dust. The small clearances necessary to effect a smooth travel of the pins in the sockets is quickly sealed in the first few minutes of use when the everpresent paper dust combines with the thin film of lubricant on the pins to form what is in effect a floating seal which precludes the entry of more paper dust.

As is common in pinwheels, the pins extend and retract upon rotation of the pinwheel due to the action of a cam riding in a track in the base of the pin. In one embodiment of the present invention, these pins are tapered or radiused to reduce their diameters on the interior portion of the pins where the wear would tend to be greatest so that, in their reciprocal movement within the pinwheel and around the camming surface, the friction and wear are reduced substantially without the use of a lubricant while at the same time providing for a smooth travel relative to the cam on which they ride.

The taper on the pin body begins roughly at the middle of the cam track. At this point, due to the forces exerted on the pin in the reciprocal movement in its seat following the cam movement, the pin body would be more likely to contact the seat walls, thereby increasing the wear at this point. By decreasing the radius at that point, the pin body will not contact the seat walls at the point of heaviest wear and the forces exerted by the cam action will be evenly distributed on the remaining pin body, in contact with the seat walls, resulting in less wear and longer pin life.

In the preferred embodiment, the pin itself is composed of a very durable material and, more particularly, fiberglass reinforced polycarbonate.

It is therefore an object of the present invention to provide a novel and improved pinwheel for paper feeding machines and the like of simple and inexpensive construction and operation.

Another object of the present invention is to reduce wear within the operation of the pinwheel with a minimal use of a lubricant.

Yet another object of the present invention is to provide increasingly exacting tolerances of all moving parts while retaining durability and long-wearing characteristics.

Still another object of the present invention is to reliably feed paper with exact registration of the paper.

A still further object of the present invention is a pin of a unique composition and shape which will decrease friction into movement within the pinwheel and have a longer wear life than heretofore possible.

DESCRIPTION OF THE DRAWINGS

These and other object and advantages of the present invention will more fully appear from the following description made in connection with the accompanying drawings, wherein like referenced characters refer to the same or similar parts throughout the several views in which:

Referring now to FIG. 1, a portion of a pinwheel and cylinder assembly 10 is shown. Spaced from the edge supportive plate 13 are pins 20 in various stages of emergence from their seats or sockets 27. The pinwheel assembly may itself be adjusted to cause the pins to emerge at a selected point on the circumference of the cylinder 30 by the adjustment and positioning of the nut 12 within the slot 11. A hub 14, is keyed by keyway 16 onto a shaft (not shown). The hub 14 is attached to the pinwheel assembly cylinder 30 by suitable machine screws 17 or other forms of fasteners. The edge supportive plate 13 has a notched extension 18 for proper positioning and support on a suitable support assembly (also not shown).

The cylinder or platen 30 in one embodiment may be cast of aluminum, milled and then into this milled surface the seats 27 for the pins 20 can be precision ground, later anodizing the aluminum for strength and durability. By this process, the seats 27 may be easily machined to extremely precise tolerances, which, as stated above, retard the entrance of paper dust and other fouling foreign particles, and yet retain the wear characteristics of a cast iron construction, which is generally regarded as necessary for an efficient and trouble-free operation. However, should it be desirable, the platen 30 may be formed of cast iron or other highly durable material and machined to the desired tolerances in a conventional manner.

Figure 1:
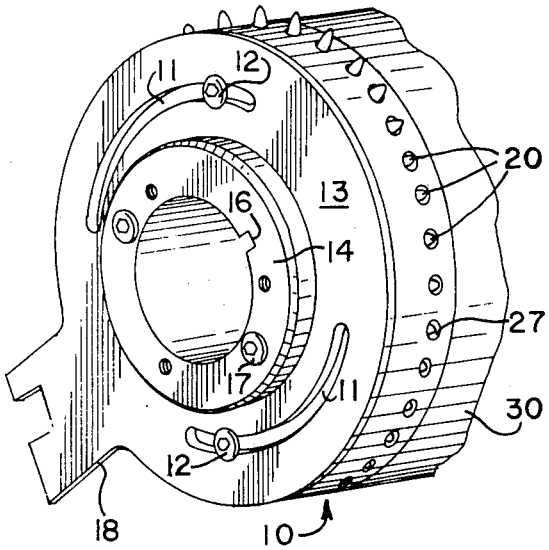
FIG. 1 shows one embodiment of the pinwheel and cylinder assembly of the present invention.
Figure 2:
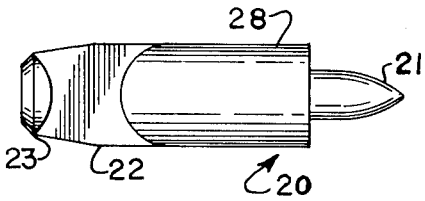
FIG. 2 shows a side view of a pin of the present invention.

The pin 20 has a head 21 and a body 28, of a unique design, as shown in FIG. 2 and can be cast of a substance suitable for a long wear life, such as a bronze or steel. The pin presents no problem in machining to exacting tolerances, being of a size that is easily handled. Even production lines can be set up to maximize efficiency in this area, since machine shops are regularly set up for applications similar to this.

In the preferred embodiment, the pins are formed of plastic, preferably of fiberglass reinforced polycarbonate, with polytetrafluoroethylene added for lubricity and reduced surface friction. In one form of this embodiment a mixture containing 20–40% fiberglass, 12–44% polytetrafluoroethylene and 30–70% polycarbonate by weight has been found to be advantageouus when molded and cured. In particular, optimum results have been observed with a mixture of 28–32% fiberglass, 20–24% polytetrafluoroethylene and 46–50% polycarbonates by weight, which is injection molded and subsequently cured. Such a mixture has been found superior in terms of wearing ability, lubricity and overall long life characteristics.

For further assurances of durability, the body 28 of the pin 20 is radiused at points 22 and 23, which points are generally opposite the midpoint and interior end, respectively, of the cam track 24. Thus, the outside diameter of the pin body 28 decreases gradually, beginning at those points. This feature results in decreased friction between the pin and the walls of the socket in which the pin travels, providing an increased pin life and decreased maintenance, due to the elimination of a major wear area and the resulting even distribution of the remaining wear force on the pin body as described above. In this manner, both the pins and the platen can be formed with maximum efficiency with reference to production cost, while an extremely precise tolerance can simultaneously be maintained.

Figure 3:
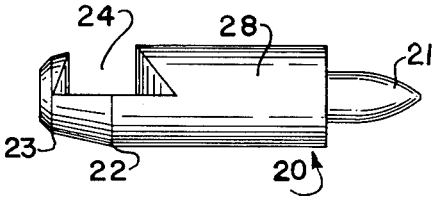
FIG. 3 shows another side view of a pin wherein the cam track may be seen.

FIG. 3 shows the follower 24 on the pin body 28 which acts as a track upon which the camming surface 32 (shown in (FIG. 4) fits.

Figure 4:
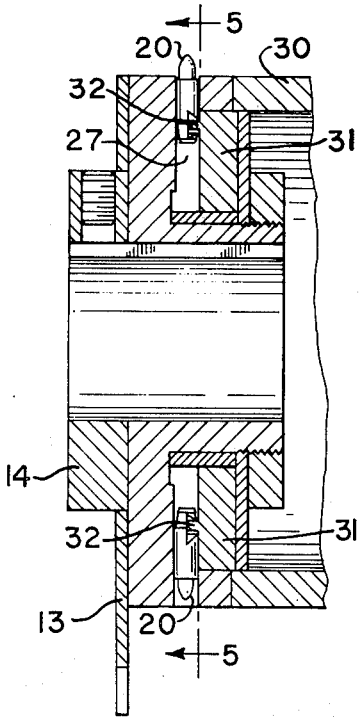
FIG. 4 is a cross section of a pinwheel and cylinder assembly of the present invention showing the relationship of the cam to the pin; and, FIG. 5 is a cross section taken along the line 5—5 of FIG. 4..

FIG. 4 shows the relationship of the pin to the cam wherein the cam 31, through the action of the camming surface 32 on the follower 24 of the pin, causes the pin 20 to move in its socket 27 in a reciprocating action as the platen 30 revolves. Thus, as shown in FIG. 4, a pin will be fully extended while the pin 180° opposite the first pin will be fully retracted, as a result of the asymmetrical shape of the camming surface 32.

The follower 24 of the pin 20 is shown to have two opposing circular or arcuate edges for engaging opposite sides of the camming surface 32. These circular edges allow the pin to ride in a smooth manner on the camming surface 32 of the cam 31. Thus, as the platen revolves and the pins 20 begin their reciprocating movement, the slightly asymmetrical camming surface 32 encounters no increased friction and reduced wear, and yet a tight fit of the pins' followers 24 on the camming surface is still possible. No freedom of movement or "play" is allowed, then, in the movement of the pin 20 within the socket 27. Exact registration of the paper forms fed by the platen is thus made possible, and the forms may then be fed to the associated apparatus without fear of fouling or misregistration.

With a pin of the above characteristics, the maintenance of the pinwheel can be lessened immeasurably as a result of the long life of the pin. As a result of the mixture above disclosed and the radiused interior end of the pin, little or no wear is observed at either of the two major wear points, the cam follower portion 24 of the pin and the body 28 of the pin. Thus, the dimensions of the pin at these portions can be made to very exacting tolerances to form a tight fit with the camming surface or the pin seat, as appropriate.

As a result of the superior lubricity of this pin, not only is a more precise and responsive following of the camming surface possible, thereby eliminating the slipping and stuttering generally associated with a sloppy and loose fit, but also provides a barrier to the entry of paper dust and other fouling material. In fact, the thin film of grease placed on the pin prior to assembly actually combines with the initial entry of paper dust to create a paste-like substance which acts as an effective seal against the entry of further foreign matter.

Figure 5:
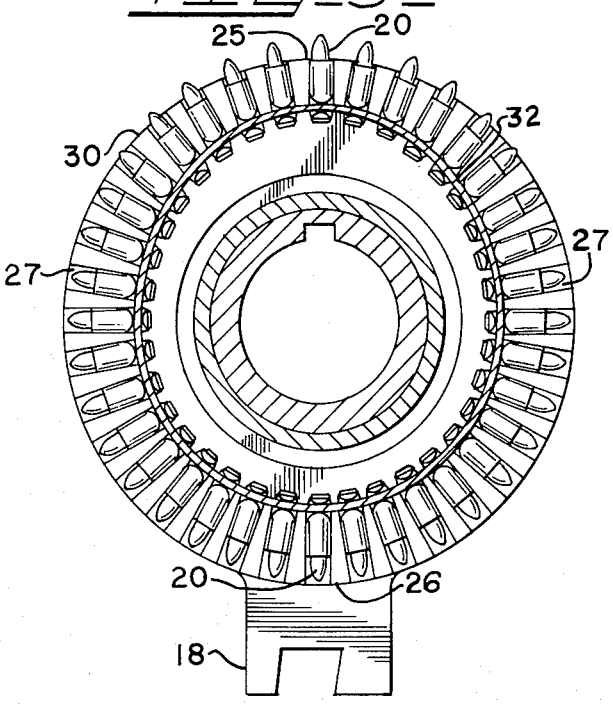

The retraction and extension of the pins can be better seen in FIG. 5, whrein at points 25 of the platen 30, the pin 21 is fully extended in the socket 27 while at point 26, 180° from point 25, the pin 21 is fully retracted in its respective socket 27. The camming surface 32 is shown in FIG. 5 to be a slightly egg-shaped circle, with that portion of the circle near the point 25 of the platen being slightly elongated, thereby causing the follower 24 of the pin 21 to ride on the camming surface 32 so as to extend the pin head 20 above the surface of the platen 30, thereby engaging the perforated paper for registration purposes. By means of this camming surface action on follower 24, the pin 21 is made to move in a reciprocating fashion in the socket 27. As this camming function is well known in the art, further discussion of the mechanics of the pinwheel operation is not necessary except as related to the invention herein.

The combination of a precisely machined platen, the arcuate follower, radiused pin body, and the use of a unique durable material for the construction of the pins all contribute to a pinwheel assembly which can be economically made with a minimum of time, providing a pin construction for maximum wear and efficiency of operation, with the use of a minimum of lubricant.

While the improved pinwheel for paper feeding has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention and that the improved pinwheel will include all embodiments falling within the scope of the appended claims.

I claim:

1. An improved pinwheel rotatable about an axis for paper feeding and the like having a cylinder, a plurality of pins formed of fiberglass reinforced polycarbonate and polytetrafluoroethylene, each of said pins being movably mounted in a seat of a certain diameter in said cylinder and having a follower, said follower being engaged with a camming surface for reciprocal travel in said seat toward and away from said axis of rotation of said pinwheel, said pin having an outside diameter closely approximating the diameter of said seat for retarding the entrance of foreign matter into such socket, said pin diameter being reduced near said follower for reduced friction while traveling in said seat, and an increased wear life.

2. The improved pinwheel apparatus of claim 1 wherein said pins are formed of a mixture of:

a. from 20–40% fiberglass;

b. from 12–44% polytetrafluoroethylene; and, c. from 30–70% polycarbonates.

3. The improved pinwheel apparatus of claim 1 wherein said follower has two opposing, aligned spaced, arcuate surfaces defining a distance at the point of closest proximity of said surfaces, said distance accommodating the engaged camming surface.

4. The improved pinwheel apparatus of claim 3 wherein said reduced outside pin diameter and said spaced arcuate surfaces cooperate to minimize friction and wear and to assure a smooth and registered travel of the pins in their respective sockets.

5. The improved pinwheel apparatus of claim 1 wherein each of said pins is formed with arcuate cam engaging surfaces to contact opposite sides of said camming surface thereby minimizing wear on said cam engaging surfaces.

6. A pinwheel feeding mechanism for feeding paper and the like having a platen, a plurality of movable feeding pins seated in sockets in said platen for continuously and progressively advancing paper and the like for an associated mechanism, wherein, said pinwheel comprises a feeding mechanism having a preformed platen of aluminum, having sockets machined in said platen to selected dimensions, said platen being anodized thereby providing a durable, yet easily machined platen, and said pins having an inside end and an outside end, said inside end being tapered from a point spaced from said outside end for providing increased wear and durability characteristics while preventing the penetration of foreign matter past said pin.

7. The improved pinwheel apparatus of claim 6 wherein said pins are formed of a fiberglass reinforced polycarbonate and polytetrafluoroethylene for long wear and high lubricity.

8. The improved pinwheel apparatus of claim 6 wherein said fiberglass reinforced polycarbonate and polytetrafluoroethylene comprise a mixture of:

12–44% polytetrafluoroethylene;

20–40% fiberglass; and,

30–70% polycarbonate.

9. An improved pinwheel rotatable about an axis for paper feeding and the like having a cylinder, a plurality of pins formed of a mixture of from 28–32% fiberglass;

from 20–24% polytetrafluoroethylene; and, from 46–50% polycarbonates, each of said pins being movably mounted on a seat of a certain diameter in said cylinder and having a follower, said follower being engaged with a camming surface for reciprocal travel in said seat toward and away from said axis of rotation of said pinwheel, said pin having an outside diameter closely approximating the diameter of said seat for retarding the entrance of foreign matter into such socket, said pin diameter being reduced near said follower for reduced friction while traveling in said seat, and an increased wear life.

10. The pinwheel of claim 9 wherein said mixture is injection molded and cured to form said pins.

* * * * *